US007115172B1

(12) United States Patent
Teodorovich

(10) Patent No.: US 7,115,172 B1
(45) Date of Patent: Oct. 3, 2006

(54) METHOD AND APPARATUS FOR PLASTER BURNISHING TOOL

(76) Inventor: Mishko Teodorovich, 6410 Yaupon Dr., Austin, TX (US) 78759

( * ) Notice: Subject to any disclaimer, the term of this patent is extended or adjusted under 35 U.S.C. 154(b) by 0 days.

(21) Appl. No.: 11/271,727

(22) Filed: Nov. 11, 2005

Related U.S. Application Data

(60) Provisional application No. 60/626,903, filed on Nov. 11, 2004.

(51) Int. Cl.
*B08B 7/00* (2006.01)

(52) U.S. Cl. ..... 134/6; 134/42; 15/235.4; 15/235.6; 15/245.1; 451/357; 451/359; 425/87; 29/90.01; 29/90.3

(58) Field of Classification Search ..... 134/6, 134/42; 15/235.4, 235.6, 245.1; 451/357, 451/359; 425/87; 29/90.01, 90.3
See application file for complete search history.

(56) References Cited

U.S. PATENT DOCUMENTS

| | | | | |
|---|---|---|---|---|
| 2,490,304 | A * | 12/1949 | Huffman | 15/235.4 |
| 4,757,572 | A * | 7/1988 | Yon | 15/235.7 |
| 6,526,639 | B1 * | 3/2003 | Duan et al. | 29/90.01 |
| 6,735,840 | B1 * | 5/2004 | Gibbs | 29/90.01 |

* cited by examiner

*Primary Examiner*—Sharidan Carrillo
(74) *Attorney, Agent, or Firm*—Rick B. Yeager

(57) ABSTRACT

An Advanced Burnishing Tool for burnishing Venetian plaster surfaces comprises a base with a working surface with a plurality of concentric ribs. The tool may be used manually or may be mounted on a power tool such as an oscillating sander. Each rib has a rounded upper portion for contacting the surface, so that each rib acts in a manner similar to the rounded edge of conventional burnishing tools. The plurality of ribs provide a simultaneous working of multiple points in the plaster surface. Efficiency is further improved when a power tool is used to reduce the manual effort required for burnishing.

3 Claims, 13 Drawing Sheets

METHOD AND APPARATUS FOR PLASTER BURNISHING TOOL

RELATED APPLICATIONS

This application is related to and claims priority from U.S. Provisional patent application No. 60/626,903 filed Nov. 11, 2004.

FIELD OF THE INVENTION

The current invention relates to devices and methods for burnishing plaster.

BACKGROUND OF THE INVENTION

Prior Art

Prior art methods for burnishing Venetian plaster are discussed below to illustrate limitations of prior art plaster burnishing tools and methods. The current invention may be used for various types of plasters including Venetian plaster, synthetic plaster, and other types of plaster-like materials that may be developed in the future.

Burnishing is a technique used to bring a high gloss shine to the dry Venetian plaster surface. High gloss is a key feature by which the quality of Venetian plaster is evaluated both for the material quality and for the applicator artist's quality of work. It is generally believed that high gloss can best be achieved by rubbing the edge of a stainless steel tool on dry Venetian plaster. Rubbing the edge of a stainless steel tool against the surface is called burnishing. Burnishing brings out the luster of the marble dust, which is an essential ingredient in all Venetian plaster, therefore distinguishing Venetian plaster, and its unique beauty, from other finishes.

Burnishing Process

The burnishing of the surface is preferably done within 7 days of the Venetian plaster application.

Using a 400 or 600 grit sandpaper, the surface is rubbed in a circular motion until the desired look is achieved. For larger areas, a power sander may be used. For a more polished look after burnishing, the flat side of a clean steel trowel may be used. The heat and friction created by rubbing produces a defined, glossy appearance.

When the second coat is completely dry, a blade is scraped across the surface to knock off any ridges or deposited material that may have accumulated. Continuing to swipe the blade across the surface will bring up a dry burnish, or a gloss effect, to the Venetian Plaster.

A higher gloss finish can be achieved with a wet burnish technique using just the blade and a little bit of plaster. A palette knife is used to apply the plaster to the blade. The amount of plaster on the blade should only be about the size of a quarter. The plaster is spread at a very low angle to the wall surface, leaving just enough room for a thumb underneath the blade. After each pass, the blade should be cleaned in order to accumulating dry pieces and scratching the surface. When this layer feels damp to the touch, but does not leave a residue on the hand, it is time to wet burnish by applying moderate pressure with the face of the blade, not digging into the surface but gliding over it using a criss-cross motion. Burnishing should continue until the Venetian Plaster takes on a desired high gloss appearance.

After burnishing, the entire wall is wiped with a slightly damp rag to remove any plaster dust.

Plaster Trowels

Common burnishing tools are stainless steel plaster trowels that vary in size from 6" to 12" in length with wood handles or soft grip handles, and that have rounded edges or square edges. The trowel that has rounded edges on both ends is called a pool trowel.

It is necessary to prepare the edges of the trowel by sanding edges to a round shape before using the trowel for burnishing. This sanding has to be repeated through out the burnishing process to insure against nicks that will scratch the surface. This tool preparation is a time consuming manual process.

One difficulty in using a standard trowel lies in its relatively heavy weight and the position of its handle on the top of the tool. Although the tool does not appear heavy, the manual use of the tool achieves a very slow progress and creates a fatigue which requires frequent breaks. There are also technical difficulties in using a manual trowel that results in additional time spent. In addition, there are also concerns with the finish quality which largely depends on the much needed strength and endurance of the individual applicator.

It is difficult to control where the edge of the trowel lands on the surface of the Venetian plaster since the grip is in the middle and on the top typically elevated by 1" to 2". In addition to lack of control, the elbow, wrist and fingers become fatigued because the handle must be gripped tightly to get a firm enough pressure to bring out the luster of the marble dust. The constant rubbing motion of the trowel held at an angle on the surface applied with steady pressure over a period of even a few minutes is tiring. Gripping the handle and pushing it into the surface over the amount of time that is necessary to burnish an entire area is nearly impossible without resting to regain strength.

It is also easy to gouge the surface of the Venetian plaster with a trowel held at an angle. The angle has to be correct consistently through the entire process to avoid this problem. This is also very difficult knowing that the trowel is only held with one (often fatigued) hand. The corners of the trowel can be used to burnish the tiny recessed areas, but the control of holding the trowel with just one hand to guide it is very difficult.

Plaster Spatula

Another tool that is commonly used is a stainless steel plaster spatula that varies in size from 6" to 10" with a plastic, wood or soft grip handle. This is sometimes called a broad knife, a coating knife, or a blue steel trowel. There is a double-blade spatula that can be used in the application of Venetian plaster. There is also a spatula that looks like a large scraper with a handle that is called a Swiss trowel.

The edge of the spatula should be sanded to round it off before use to prevent scraping and gouging of the surface. The sanding needs to be repeated to eliminate nicks that may appear which can scratch the surface of the Venetian plaster. The smaller the length, the more control one has because a lot of pressure must be exerted to polish the surface.

Gouging and scratching the surface and fatigue are the primary difficulties in using the spatula. In order to get enough pressure to burnish, the trowel handle is held steady in the crook of the thumb at an angle while the fingers are pressing on the blade close to the edge. This pressure must be steady through out the burnishing process to achieve a consistent polish. This process is extremely fatiguing for the fingers and the applicator must frequently rest to regain strength. The angle of the spatula must be correct or the surface of the Venetian plaster will be gouged.

Scrapers

Small, thin stainless steel scrapers called Japanese scrapers or knives typically come in a package of four sizes, the smallest being 2" and the largest being 5". These are without handles. The Japanese knives must also be sanded before use and during the process to prevent scratches and gouges.

One difficulty in using the Japanese knives is their size. They are too small to be practical in covering a large surface in a reasonable amount of time. It is also fatiguing to use them because the top end must be held up with the thumb to get the correct angle, and the edge must be pressed down firmly with the fingers to apply enough pressure to polish the surface of the Venetian plaster. Again, one must rest often while using these knives to regain strength.

Blading

The fastest way to burnish is to rapidly drag the trowel over the surface in different directions ignoring recessed areas. This brings an intermittent shine to some areas of the Venetian plaster, but not a consistent, even gloss. This technique is called "blading".

Sandpaper

Another technique is to use 1,000–2,000 grit sandpaper sanding evenly with a figure eight pattern. Then clean the surface with a dry rag followed by a slightly damp rag. However, this sanding does not bring a traditional high gloss polish to the surface.

DISADVANTAGES OF PRIOR ART TECHNIQUES

The prior art burnishing techniques involve using a hand-held stainless steel tools and rubbing in a small circular motions or back and forth on a Venetian plaster surface. Applying more pressure will create a higher level of gloss, as will several passes. This is a fatiguing, time consuming, tedious, and expensive process.

There is a need for methods and devices that permit a more efficient burnishing of plaster.

SUMMARY OF INVENTION

In one embodiment of the current invention, the Advanced Burnishing Tool™ (ABT) has multiple edges, such as contiguous rounded ribs, and may include a rounded perimeter rib.

In one embodiment, the tool is made from a hard material such as stainless steel. In other embodiments, the tool is made from aluminum, a plastic coated metal, a plastic, or other material.

The ABT replicates the use of many single edge tools, that are rubbing the plaster and oscillating together at one time. The tool may burnish the plaster 10 to 20 times faster than what is possible with standard single-edge hand-held tools such as trowel, spatula, or Japanese knife. The ABT can be used manually or may be attached to a power tool used for sanding, such as a Black and Decker Mouse Sander™ model MS550 GB or MS 500K.

In one embodiment, a complete rounded rib perimeter adds additional edges, and allows one to burnish rounded surfaces. The rounded, pointed tip and bottom corners aimed into the recessed areas burnish instantly and without gouging. The oscillation of a power sanding tool such as the Black & Decker Mouse Sander™ improves the polishing while reducing the need for applied pressure. The power tool base to which the ABT attaches is small and fits comfortably in the palm of a hand. It is not necessary to grip the electric base tightly or for physical exertion, such as pressing the tool onto the Venetian plaster surface to achieve the desired gloss. The ABT is simply placed on the surface flat, and at whatever angle is required to reach the more recessed areas, to accomplish the highest possible polish.

In other embodiments, the ABT is a manual tool. Manual versions of the tool provide dramatic increases in burnishing efficiencies by providing multiple ribs or edges for simultaneous burnishing of different points on a plaster surface.

Many clients who desire Venetian plaster do not request it because, using the current hand-held burnishing system, the time required to polish the surface to a high gloss makes the cost prohibitive. Decorative plaster manufacturers and schools try to invent short-cut burnishing techniques to persuade students and applicators to use Venetian plaster and, thereby, to buy their products. Currently there is not a short cut that can produce the high gloss polish of authentic Venetian plaster of the quality provided by the ABT.

With ABT, the time and cost involved in doing a Venetian plaster finish are drastically improved. The decorative artist can offer it to a client at a more reasonable rate, and produce the finish much more often since the time involved in the burnishing process is dramatically decreased.

One advantage of the ABT is that the speed of the burnishing process is increased relative to prior art techniques. Another advantage of the ABT is that the multiple polishing ribs and oscillating motion of the ABT provides a desirable, high-quality glossy finish. Another advantage is a substantial reduction or elimination of physical exertion, which eliminates fatigue and the necessity of frequent rest that is common with hand-held tools. These advantages provide an opportunity to make Venetian Plaster finishes much more affordable and higher quality, and to increase the use of Venetian Plaster worldwide.

DESCRIPTION OF FIGURES

These and other features, aspects, and advantages of the present invention will become better understood with regard to the following description, appended claims, and accompanying drawings where:

DETAILED DESCRIPTION OF THE INVENTION

ABT tool with Ryobe™ Power Sander

The ABT tool can be used by hand or can be attached to an oscillating power tool such as an oscillation sander. In this embodiment, the ABT is designed to be installed on a small hand sander that typically is used for abrasive grit sanding.

In one embodiment, the ABT is attached to the sander using a hook and loop fastener means that is adhered to the ABT tool. The sander thus eliminates to need to hand rub the ABT against the plaster to achieve the burnished finish. In other embodiments, the ABT tool may be attached to the sander with an adhesive, a clamping means, recessed screws, or other mounting means. The outer back edge of the ABT base may have a ridge that slips over the outer surface of the sander pad to facilitate quick and accurate placement of the ABT tool on the sander.

In this example, the ABT tool has continuous ridges with smooth round edges on a working face that allow the plaster to be burnished without gouging. The tool has multiple ridges, which result in much faster burnish action than a single edge hand tool. The tip of the ABT tool is pointed to allow reaching into corners and hard to access areas of a typical wall.

The ABT can be manufactured from hard plastic, or a metal, such as steel stainless steel, titanium or other metal. It can be machined, cast, or stamped. It is more effective if made out of lighter material such as aluminum, because the existing oscillating power tools are designed for lighter attachments such as sand paper. If made from aluminum, the ABT is preferably coated, due to aluminum leaving mars on the plaster. Coating with Tufram™ may be used.

In other examples, the ABT can be manufactured from a flexible material and used on radiused surfaces such as columns.

Figure 1:
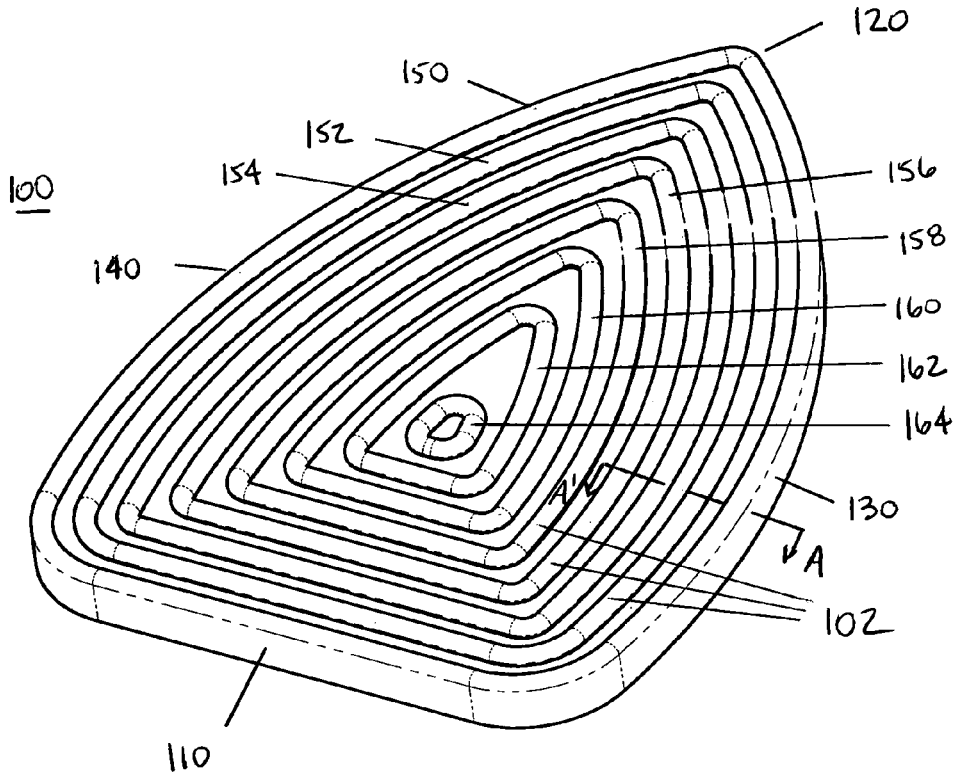
FIG. 1 is a perspective view of the working face of one embodiment of a tool.

FIG. 1 is a perspective view of the working face 102 of one embodiment of a tool 100. In this embodiment, the tool has a generally rounded triangular shape which includes a foot portion 110, a pointed nose portion 120, a first side 130, and a second side 140. In this example, there is an outer rib 150, and 7 concentric inner ribs 152, 154, 156, 158, 160, 162, and 164. In other examples, various tool shapes, rib profiles, and rib spacings may be used. This embodiment is designed for a Ryobe power oscillating tool. In this example, the bottom of the tool is the working face. In other examples, a working face may be provided in other orientations relative to a power tool or manual handle.

The shape of the device is shown as generally triangular because that shape matches existing hand-held power sanding devices. The shape is not limited to triangular, and other shapes can be used for either manual tools or tools mounted on power devices. In some embodiments, a variety of shapes of interchangeable tools may be provided so that the user can select a desired shape to match a particular wall, column, trim, or ceiling profile.

Figure 2:
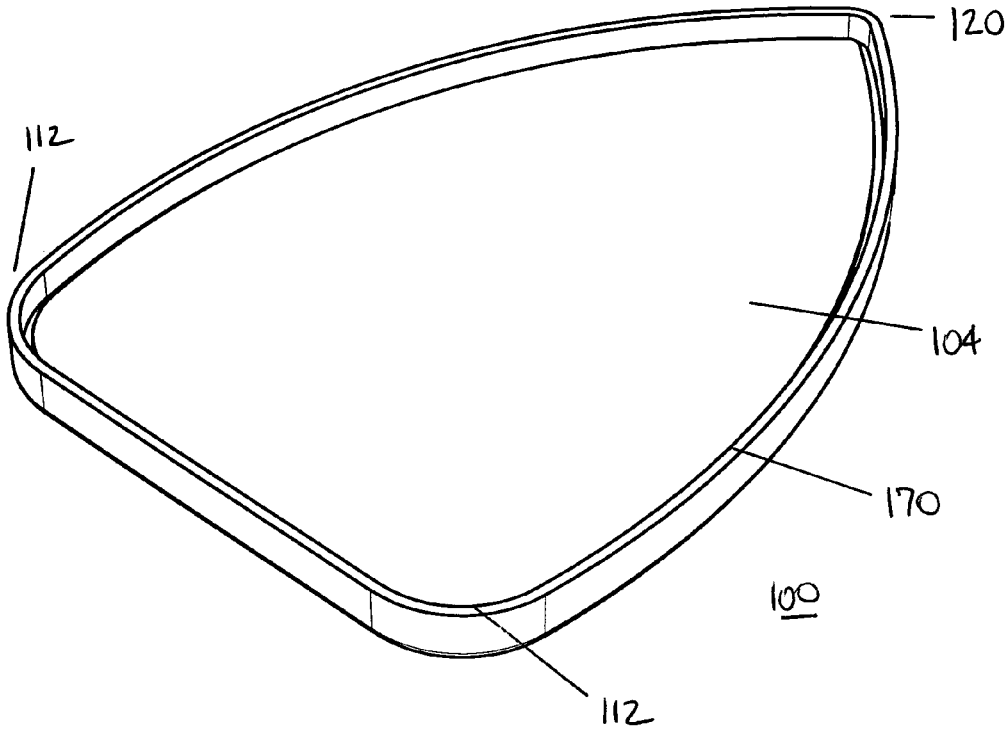
FIG. 2 is a perspective view of the handle face of one embodiment of a tool.

FIG. 2 is a perspective view of the handle face 104 of one embodiment of the tool 100 of FIG. 1. A top lip 170 extends around the periphery of the tool, so that the lip may be inserted over the mounting plate of an oscillating sander. In this example, the plate has a width of 3.98" and length 5.62" for a Ryobe sander, and a height or thickness of 0.265" and 0.080" rib height. The nose portion 120 has a radius of 0.185", and the foot portion corners 112 have a radius of 0.69".

In this example, the top of the tool is a handle face. A manual handle may be removably attached with a hook and loop fastener means or other mounting means. A mounting means such as a hook and loop fastener means may also be used to attach the tool to a power device. In this example, a single tool can be used either manually or with a power device. We can attach the handle on the Velcro. In other examples, a manual grip may be integral to the tool.

Figure 3:
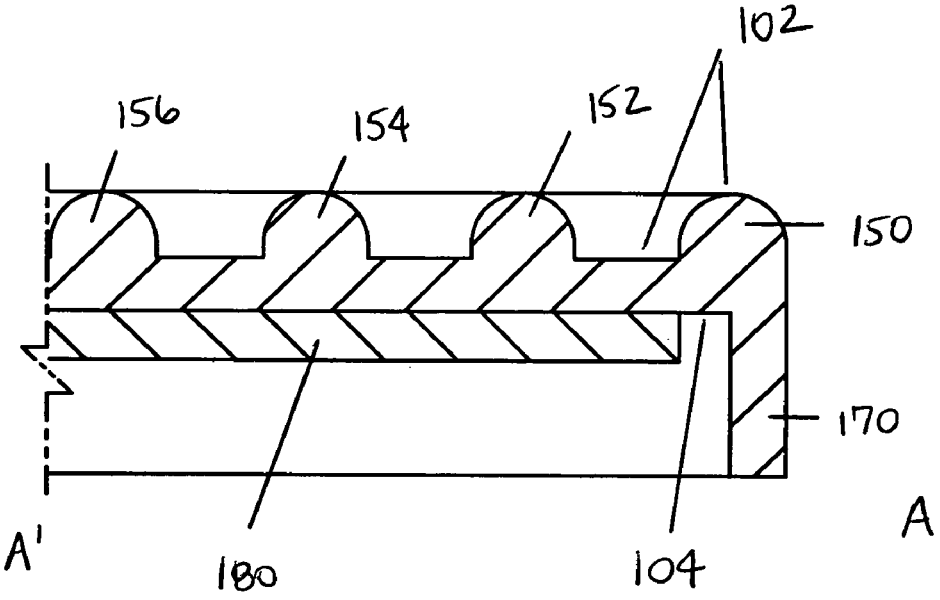
FIG. 3 is a cross section view of a portion of the working face of FIG. 1 at A–A'.

FIG. 3 is a cross section view of a portion of the working face of FIG. 1 at A–A'. FIG. 3 is a cross section view along the long axis of the tool of FIG. 1 showing a cross section of the outer rib 150, and the first three concentric inner ribs 152, 154, and 156. In this embodiment, the ribs have a lower cylindrical portion with a hemispherical top that has a radius of 1.5 mm. The total height of the ribs in this example is 2.03 mm. The top of the ribs are polished to a finish of 16 microinches. In other embodiments, other shapes and heights of ribs may be used.

In this example, a first portion of a hook and loop fastening means 180 is provided on the handle face 104 so that the tool can be attached to a power device such as an oscillating sander.

DETAILED DESCRIPTION OF THE INVENTION

ABT Tool with Black & Decker™ Power Sander

This embodiment is designed for a Black & Decker power oscillating tool. This example is slightly smaller than the Ryobe example described above, and includes seven concentric ribs. In this example, the ribs have the same profile as the ribs in the previous embodiment. In other examples, the rib profile may be changed.

DETAILED DESCRIPTION OF THE INVENTION

ABT Manual Tool

In this embodiment, a burnishing tool is provided for manual use. In one example, the tool comprises a base with a plurality of burnishing features, such as ribs, and a handle. The handle may be permanently or removably attached to the tool.

Figure 11:
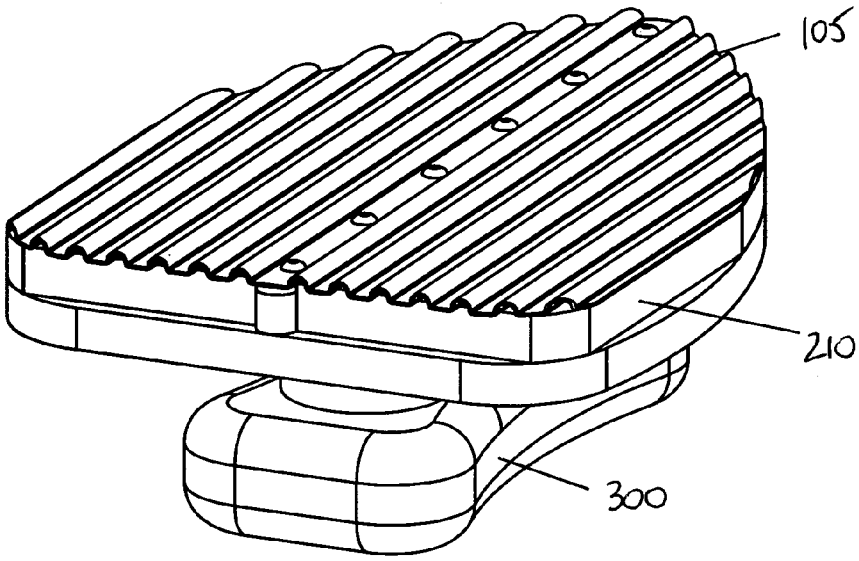
FIG. 11 is a perspective view of the working face of FIG. 7 with a handle.
Figure 12:
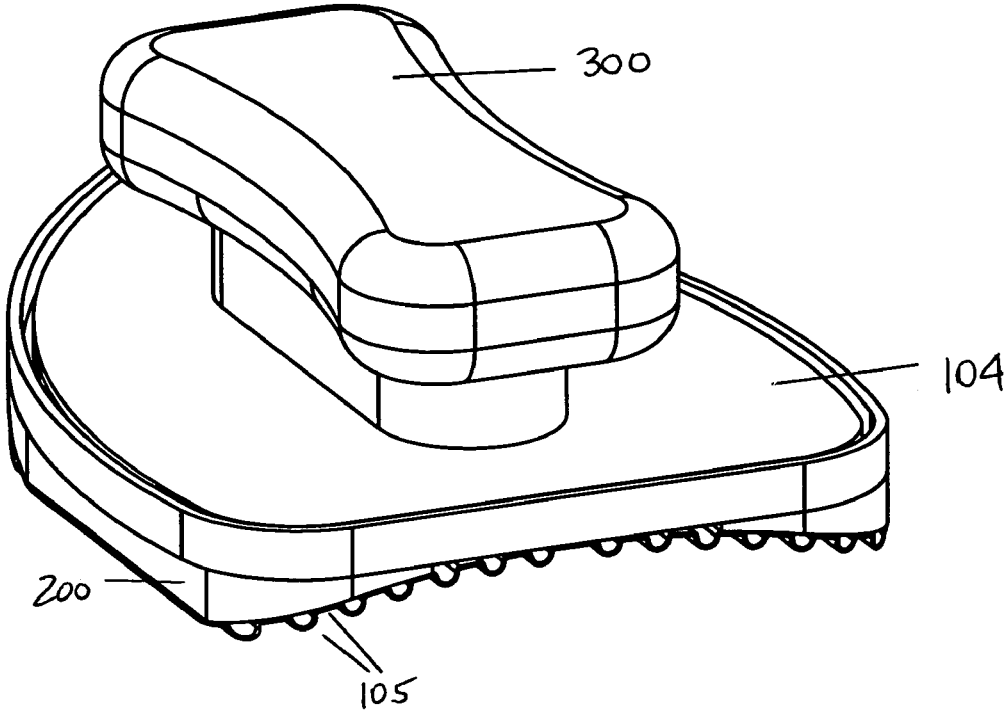
FIG. 12 is a top perspective view of the working face of FIG. 4 with a handle and an insert.
Figure 13:
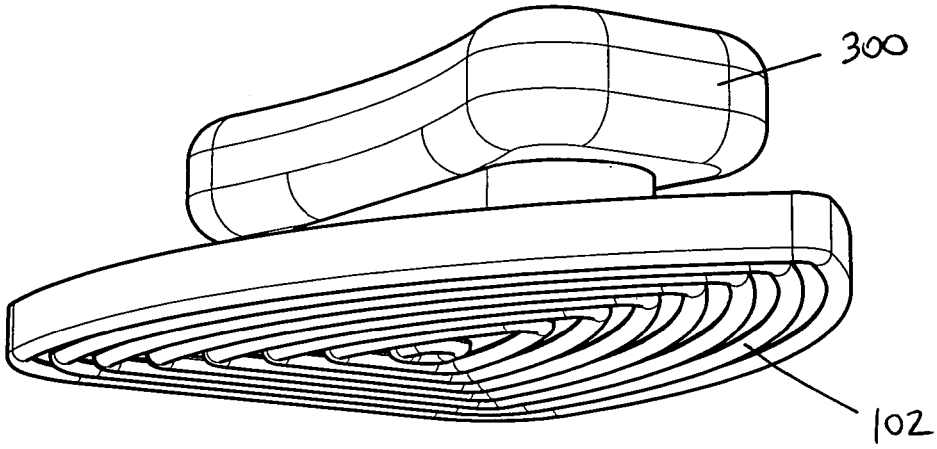
FIG. 13 is a bottom perspective view of the working face of FIG. 1 with a handle.

FIGS. 11, 12, and 13 show various tools with handles. Other shapes of handles or grips may be provided.

DETAILED DESCRIPTION OF THE INVENTION

ABT Tool for Columns

In this embodiment, the manual or power tool is adapted for use in burnishing columns. Typical residential columns have a radius of about 5 to 12 inches. Commercial columns may have a larger radius.

Other versions of the ABT tool are configured to allow the burnishing process to be applied to round or columnar surfaces.

In one configuration, the ridges are constructed on a flexible insert that is formed to a nominal free state radius that would represent the minimum curvature that could be burnished. If the surface that is to be burnished is of a greater curvature, additional pressure is applied and the flexible insert conforms to the contacted surfaces curved surface. This allows the ABT curved insert to burnish a nearly flat surface. In practice, multiple inserts are provided in radii of various increments that approximate the curvature of the surface to be burnished to minimize the applied pressure.

Another embodiment provides rigid burnishing plates of various radii so that a desired size may be selected. Manual tools may be provided with a handle. In other examples, tools may be adapted to power devices with a flexible insert pad such as urethane.

Figure 4:
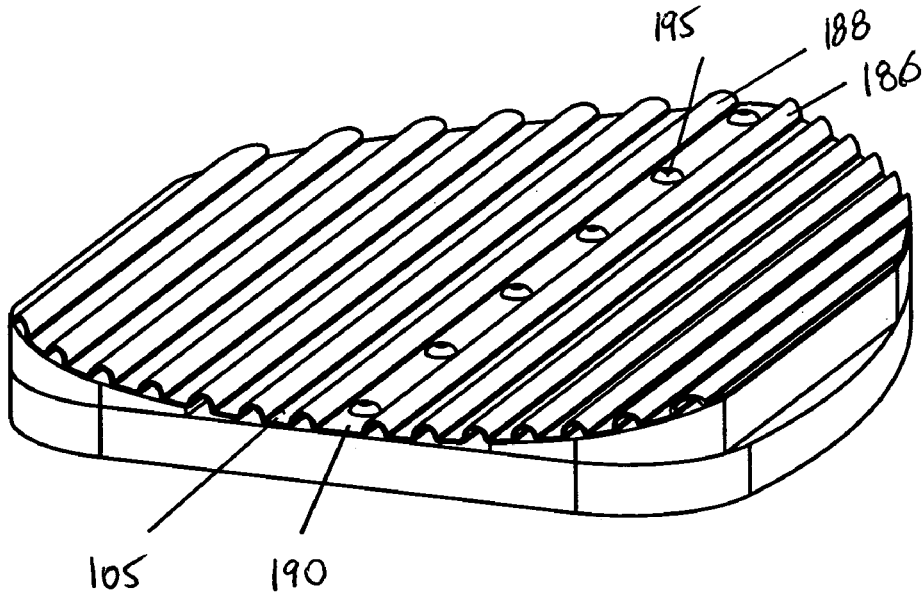
FIG. 4 is a perspective view of the concave working face of an embodiment of a tool.

FIG. 4 is a perspective view of the concave working face 105 of an embodiment of a tool. This embodiment shows parallel ribs 186 and 188 rather than concentric ribs. In this example, screws 195 may be used to mount the base 190 to a power sander or manual handle.

Figure 5:
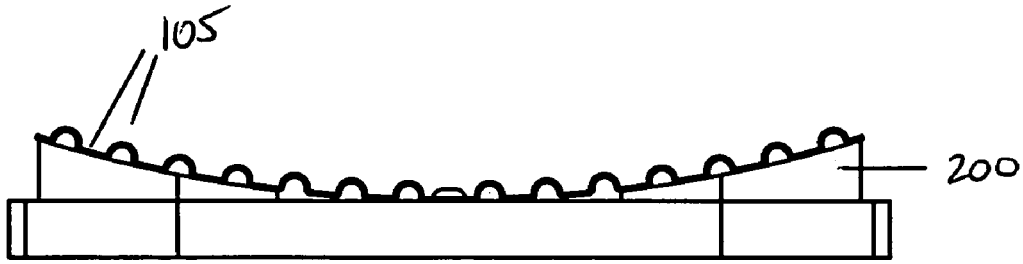
FIG. 5 is a cross section view of the working face of FIG. 4.

FIG. 5 is a cross section view of the working face 105 of FIG. 4. In this example, the support 200 may be a rigidly formed material such as a plastic. Alternately, the support 200 may be a compliant material to permit the working surface to conform to a column or other curved plaster surface.

Figure 6:
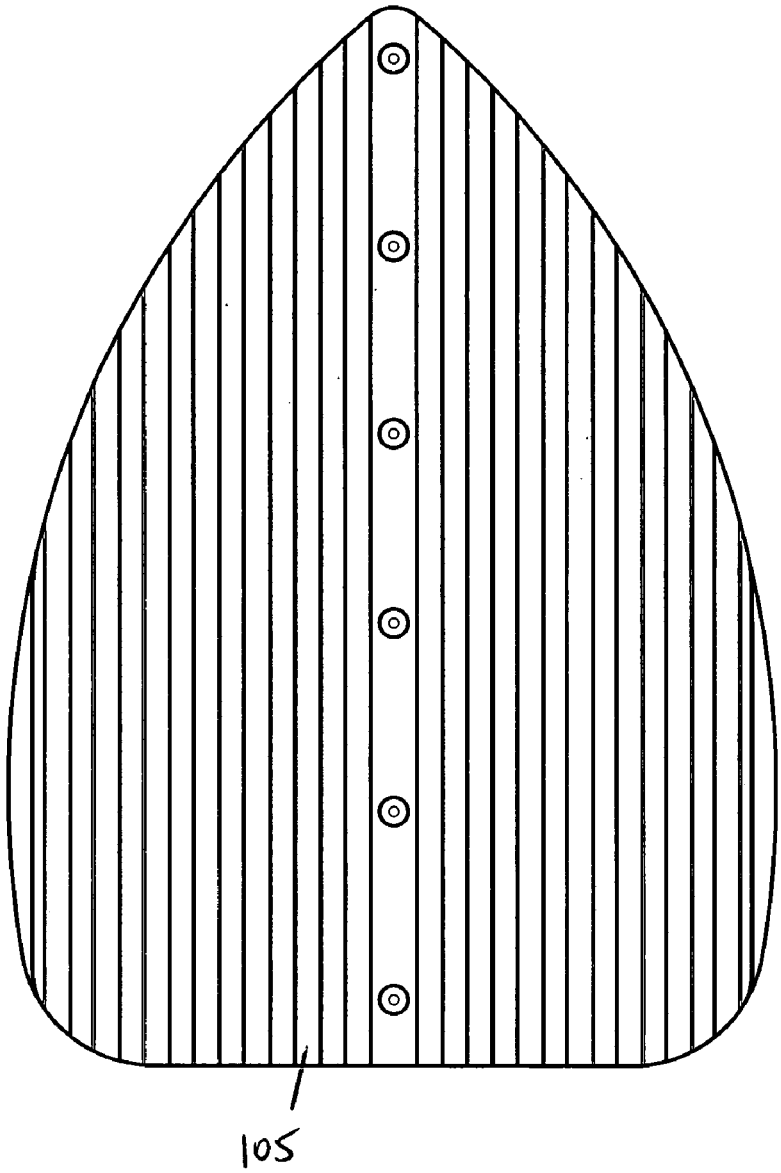
FIG. 6 is a top view of the working face of FIG. 4.

FIG. 6 is a top view of the working face 105 of FIG. 4.

FIG. 12 is a top perspective view of the working face 105 of FIG. 4 with a handle 300 and an insert 200.

Figure 7:
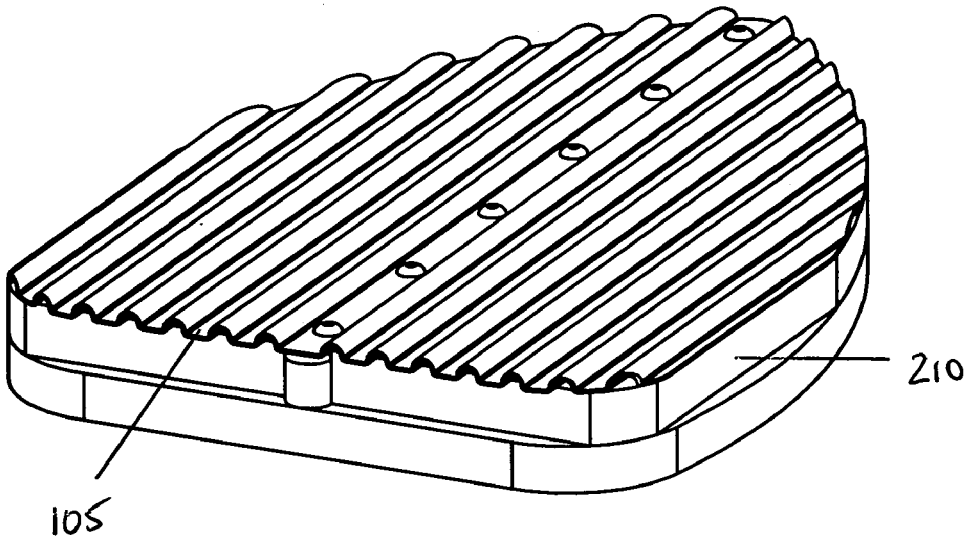
FIG. 7 is a perspective view of a flexible working face of an embodiment of a tool.
Figure 8:
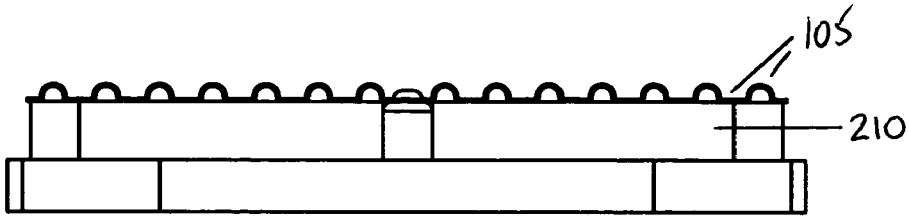
FIG. 8 is a cross section view of the working face of FIG. 7.

FIG. 7 is a perspective view of a flexible working face 105 of an embodiment of a tool on an elastic insert 210. FIG. 8 is a cross section view of the working face of FIG. 7.

Figure 9:
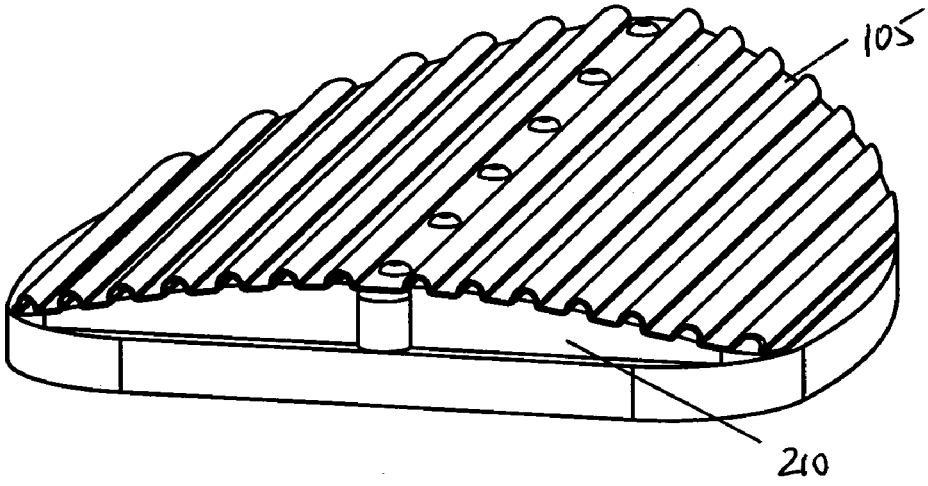
FIG. 9 is a perspective view of the flexible working face of FIG. 7 in a convex shape.
Figure 10:
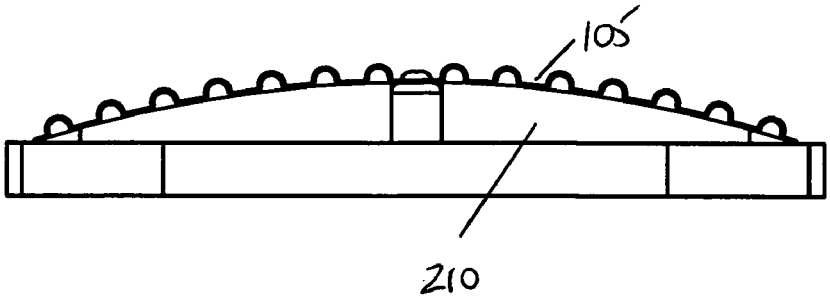
FIG. 10 is a cross section view of the working face of FIG. 9.

FIG. 9 is a perspective view of the flexible working face 105 of FIG. 7 bent in a convex shape. FIG. 10 is a cross section view of the working face of FIG. 9. FIG. 11 is a perspective view of the working face of FIG. 7 with a handle 300.

DETAILED DESCRIPTION OF THE INVENTION

Tool Variables

The burnishing process involves many variables associated with the desired visual effects, and different plaster materials that the artisan may seek. Alternate shapes and patterns of the ridges, space between the ridges, on the ABT can be constructed to achieve the desired visual burnishing effect. Additionally, the operating speed of the power sander or the magnitude of oscillation can be varied to accommodate these variables.

What is claimed is:

1. A method of burnishing a plaster surface, the method comprising providing a burnishing tool, the tool comprising a base comprising a handle face, and a working face comprising a plurality of spaced apart ribs projecting from the working face, the ribs having rounded upper surfaces for engaging and burnishing the plaster surface; and repeatedly pressing a portion of the plaster surface with at least a portion of the working face of the burnishing tool, thereby simultaneously burnishing multiple points points in the portion of the plaster surface.

2. The method of claim 1 wherein providing a burnishing tool further comprises providing a manual grip; and repeatedly pressing a portion of the plaster surface with at least a portion of the working face of the burnishing tool is performed manually.

3. The method of claim 1 wherein providing a burnishing tool further comprises mounting the tool on a power tool used for sanding; and repeatedly pressing a portion of the plaster surface with at least a portion of the working face of the burnishing tool is performed with the assistance of the power tool.

* * * * *